US005781871A

United States Patent [19]

Mezger et al.

[11] Patent Number: 5,781,871

[45] Date of Patent: Jul. 14, 1998

[54] METHOD OF DETERMINING DIAGNOSTIC THRESHOLD VALUES FOR A PARTICULAR MOTOR VEHICLE TYPE AND ELECTRONIC COMPUTING UNIT FOR A MOTOR VEHICLE

[75] Inventors: Manfred Mezger, Markgroeningen; Klaus Ries-Mueller, Bad Rappenau, both of Germany

[73] Assignee: Robert Bosch GmbH, Stuttgart, Germany

[21] Appl. No.: 546,854

[22] Filed: Oct. 23, 1995

[30] Foreign Application Priority Data

Nov. 18, 1994 [DE] Germany ..... 44 41 101.4

[51] Int. Cl.[6] ..... G07C 5/08

[52] U.S. Cl. ..... 701/33; 701/32

[58] Field of Search ..... 364/424.034, 424.036, 364/424.037, 424.038, 424.04, 550, 551.01, 552, 554

[56] References Cited

U.S. PATENT DOCUMENTS

| | | | |
|---|---|---|---|
| 4,441,359 | 4/1984 | Ezoe | 364/424.038 X |
| 5,318,449 | 6/1994 | Schoell et al. | 364/424.038 X |
| 5,463,567 | 10/1995 | Boen et al. | 364/551.01 |
| 5,499,196 | 3/1996 | Pacheco | 364/552 |
| 5,539,638 | 7/1996 | Keeler et al. | 364/424.034 |
| 5,541,840 | 7/1996 | Gurne et al. | 364/424.038 |
| 5,638,273 | 6/1997 | Coiner et al. | 364/424.04 |

OTHER PUBLICATIONS

H.E. Schurk et al. BMW On-Board Diagnose, VDI Report 612, pp. 387–401, 1986. No Translation.

*Primary Examiner*—Michael Zanelli
*Attorney, Agent, or Firm*—Kenyon & Kenyon

[57] ABSTRACT

A method of determining diagnostic threshold values for a particular motor vehicle type is proposed, the motor vehicles of the motor vehicle type being equipped with an electronic computing unit and the electronic computing unit having a programmable memory module and a microcomputer, as well as an interface for data communication with an external computer. The diagnostic data of each available motor vehicle of the particular motor vehicle type are transmitted to an external central computer and stored there in a database of the central computer. Then a statistical distribution is formed on the basis of the diagnostic data compiled there. Then at least one diagnostic threshold value for a certain diagnostic data item is established on the basis of this statistical distribution. A suitable electronic computing unit, which programs the newly established diagnostic threshold values into the programmable memory module, is likewise proposed.

13 Claims, 3 Drawing Sheets

| | |
|---|---|
| VEHICLE MANUFACTURER | FT |
| VEHICLE MODEL | |
| ENGINE MODEL | |
| MILEAGE | |
| VEHICLE IDENTIFICATION NUMBER | DD |
| COMPUTED FUEL/AIR MIXTURE | |
| COMPUTED UNSTEADY RUNNING | |
| BATTERY VOLTAGE | |
| λ PROBE VOLTAGE AFTER SECONDARY AIR INJECTION | |
| INTAKE PIPE PRESSURE AFTER OPENING THE EXHAUST GAS RECIRCULATION VALVE | |

METHOD OF DETERMINING DIAGNOSTIC THRESHOLD VALUES FOR A PARTICULAR MOTOR VEHICLE TYPE AND ELECTRONIC COMPUTING UNIT FOR A MOTOR VEHICLE

BACKGROUND INFORMATION

The diagnostic regulations for motor vehicles, in particular for the engine control systems in motor vehicles, are becoming ever more extensive. As a consequence, during the development and application phase of motor vehicle control systems, even more diagnostic threshold values for particular data to be diagnosed are to be established in the motor vehicle control system. An engine control system is to be taken as an example. The situation with engine control systems is now such that certain countries have a legal requirement that all the subsystems of such an engine control system relevant to the exhaust have to be monitored during operation of the motor vehicle. As soon as a fault is detected in one of the subsystems, a fault message must be issued to the driver.

The establishment of the diagnostic threshold values for the data to be diagnosed concerning the individual subsystems nowadays takes place in most cases by just a few motor vehicles of a particular vehicle type being diagnosed on special test stands and during special test drives, the data of which being recorded in various operating states and the diagnostic threshold values finally being established on the basis of the recorded data for the various operating states.

In this case there is, however, the problem that it is very difficult to estimate from the outset the range of variation of the vehicles and components produced later. As a consequence of this, wrong values are established, in particular diagnostic threshold values are set too close together and error messages which are not necessary or justified are issued to the driver. There is then erroneous fault detection. On the other hand, it may be that, for precautionary reasons, certain diagnostic threshold values are set too far apart, with the result that undetected faulty operation can occur, with harmful effects to the environment.

The report by H. E. Schurk, W. Weishaupt and F. Bourauel BMW-ON-BOARD-Diagnose (BMW ON-BOARD diagnostics), VDI Report 612, pages 387–400, 1986, describes an electronic control device with self-testing means which has a serial interface. A service tester can be connected to the serial interface. The service tester can be used, for example, to interrogate the fault memory of the control device, clear the fault memory, selectively activate certain outputs, etc. A programming of characteristic curves in the control device is also possible by means of the service tester. However, it is not possible to use it for subsequently replacing diagnostic threshold values in the control device by newly established diagnostic threshold values.

SUMMARY OF THE INVENTION

The method according to the present invention has the advantage of avoiding the erroneous establishment of diagnostic thresholds. Consequently, unnecessary time spent on repair and costs are avoided. Furthermore, the application work on the motor vehicles is also simplified. This makes more accurate monitoring of the vehicles possible. Environmentally harmful operating characteristics can be detected and prevented earlier. The driver of a vehicle can be made aware of the aging characteristics of his vehicle, with the result that he can, if need be, adapt his own driving behavior to these characteristics. In addition, a clear picture of the stock of vehicles is obtained with respect to respect to its technical state, which can be used for introducing taxation-related and insurance-related technical measures. The aging characteristics and the multiplicity of data can be used to obtain valuable information for the development of new vehicles.

By programming the diagnostic threshold values, established in accordance with the principles of the present invention, in the programmable memory of the vehicle, in the case of new vehicles or in the time spent in a workshop by an old vehicle of the associated vehicle type, erroneous diagnoses of the vehicle will be avoided in the future.

It is also advantageous if, on the basis of an analysis of the diagnostic data in the database, program parts of the control program of the electronic computing unit are optimized and the optimized program parts are programmed into the programmable memory of the electronic computing unit of a vehicle of the vehicle type. This makes it possible to benefit immediately in the field from the experience gained by the creation of the database.

As the interface for the data communication, use may advantageously be made of a serial diagnostic interface which, in the time spent by the vehicle in a workshop (for example servicing), is connected to an external testing system in order to pick up the data to be diagnosed from the corresponding vehicle. In practice, the diagnostic data transmitted to the external testing system is then transferred from there to the central computer. Modern engine control devices have, for example, diagnostic interfaces, with the result that there is no additional outlay for data transfer.

It is also very advantageous if, as the interface for data communication, use is made of an interface for wireless communication with the central computer or a computer connected upstream of the central computer. This is so since it gives rise to the possibility of being able to call up the diagnostic data concerning a vehicle at any point in time. Vehicles in which faulty operation has been established can then be called into the workshop for inspection by a corresponding circuit via the diagnostic lamp present in any case.

The wireless communication can also take place via satellite. As a result, the diagnostic data of vehicles can be easily acquired over a large part of the earth's surface.

For an electronic computing unit for a motor vehicle, it is advantageous if it has means for subsequently programming in newly established diagnostic threshold values. If it is found subsequently that the original diagnostic threshold values are incorrectly set, faulty operation of the control device can be avoided by replacing these diagnostic threshold values.

DETAILED DESCRIPTION

Figure 1:
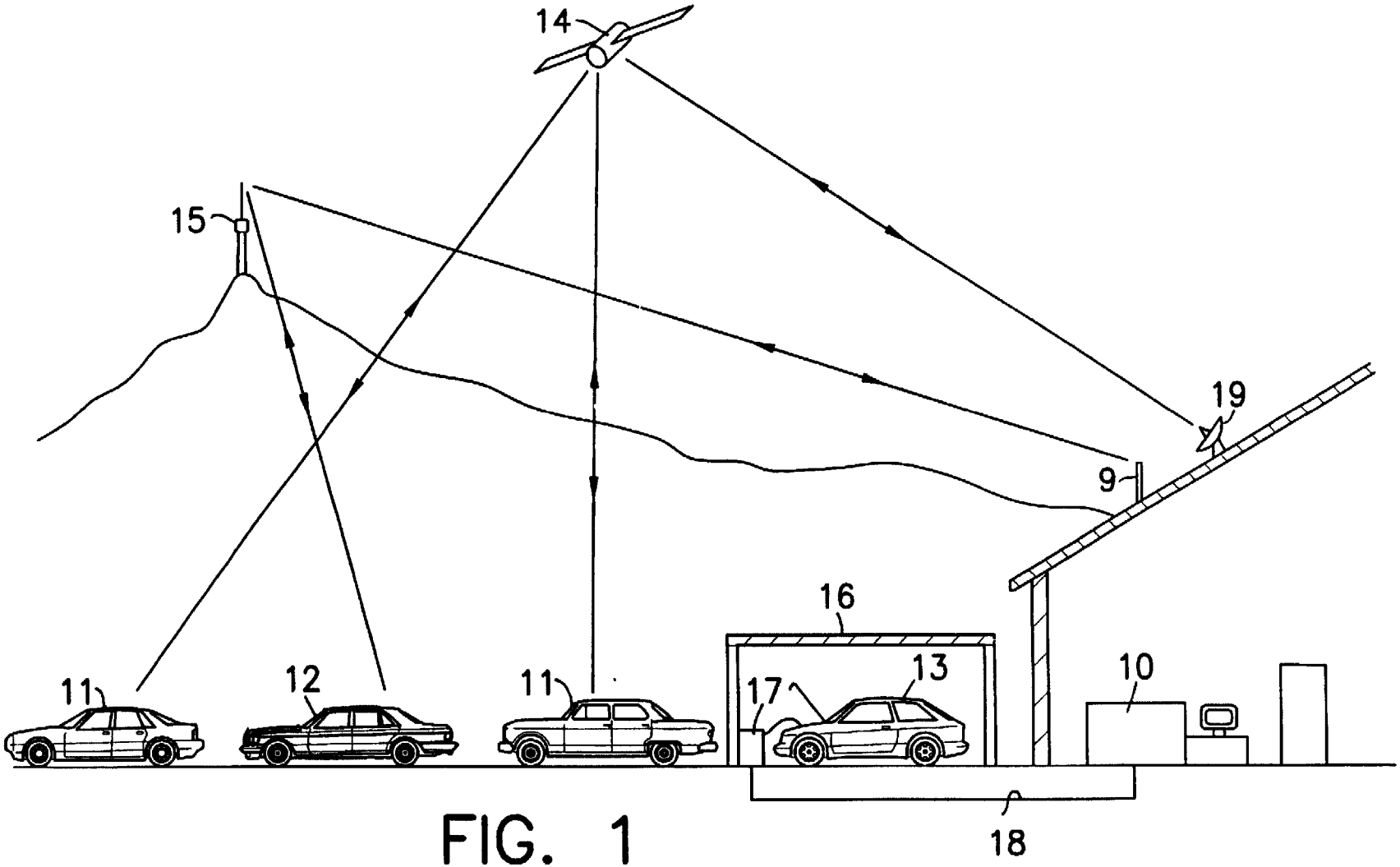
FIG. 1 shows three different possible ways in which the diagnostic data of a vehicle can be transferred to a central computer.

In FIG. 1, the reference numeral 10 denotes a central computer. In the central computer 10, there is created a database, in which the diagnostic data of specific motor vehicle types is stored. The term "motor vehicle type" is understood for the purposes of this application as meaning that several features of the vehicles which belong to a motor vehicle type must coincide. As an example of the features which define a motor vehicle type, mention is made here of the vehicle model of a vehicle manufacturer and the engine type used in it. When specifying the engine type, it must be taken into consideration that the engines of an engine type should have the same cubic capacity and should use the same fuel. Additional features which have to coincide could also be established here, such as for example the injection system used for controlling the engine, the presence of a turbocharger, the presence of an automatic transmission, etc.

A separate database is created in the central computer 10 for each different motor vehicle type. In FIG. 1, two vehicles which belong to a first motor vehicle type are denoted by the reference numeral 11. The reference numeral 12 denotes a vehicle of a second motor vehicle type and the reference numeral 13 denotes a vehicle of a third motor vehicle type. According to the present invention, the vehicles of a vehicle type transmit their diagnostic data to the central computer 10 at certain time intervals. In the simplest case, this may take place while the vehicle is spending time in a workshop, for example for servicing. This case is represented in FIG. 1. The reference numeral 16 denotes the workshop. The vehicle 13 is in the latter.

The vehicle is connected to an external testing computer in the conventional way. The external testing computer 17 extracts the diagnostic data of the motor vehicle 13. At a suitable point in time, the external testing computer 17 then transmits the recorded data of the vehicle 13 to the central computer 10. For this purpose, the central computer 10 is connected to the external testing computer 17 via a data line 18. The data could, however, also be transported to the central computer 10 by, for example, portable mass storage means, such as floppy disks, magnetic tapes or magnetic disks, and then be fed in from there into the central computer 10.

Another type of data transmission to the central computer 10 is shown in the case of the vehicles 11 of the first motor vehicle type. These send their diagnostic data wirelessly to a satellite 14 at certain time intervals during operation. From there, the diagnostic data are transmitted to a receiving station 19. Connected to the receiving station 19 is the central computer 10, which takes over the data received.

A third possibility for data transmission is likewise shown in FIG. 1. In this case, the vehicle 12 of the second motor vehicle type transmits its diagnostic data likewise by radio to a radio mast 15, from which the diagnostic data are relayed to a receiving antenna 9, which in turn is connected to the central computer 10.

In the vehicle 13, a conventional diagnostic interface is sufficient for transferring the data. In the case of the vehicles 11, 12, for this purpose there must be a more complex interface for the wireless communication, which however is also now publicly available.

Figures 2, 3:
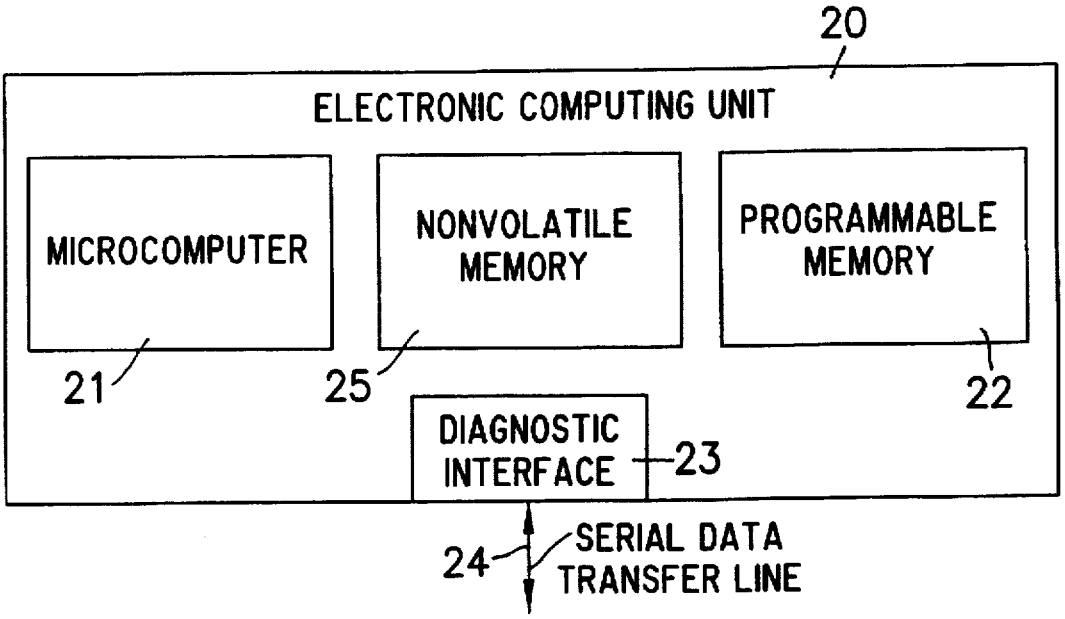
FIG. 2 shows a block diagram of a motor vehicle control device.
FIG. 3 shows an example of a data record for storing in a database.

In FIG. 2, the reference numeral 20 denotes an electronic computing unit for the vehicle 13. The electronic computing unit is provided here for controlling the internal combustion engine. Contained in it is a microcomputer 21, a programmable memory 22 and a nonvolatile memory 25. For communication with the external testing computer 17, the electronic computing unit 20 also has a diagnostic interface 23. The diagnostic interface 23 is designed as a serial interface. The diagnostic data are transferred via the connectable serial data transfer line 24.

The electronic computing unit 20 does not necessarily have to be designed as an engine control device. It could instead be designed, for example, as a diagnostic computer within the motor vehicle.

Apart from various characteristic curves and characteristic maps in the programmable memory 22 there are also stored diagnostic threshold values. With the aid of a diagnostics program in the nonvolatile memory 25, various diagnostic data can be determined in the electronic computing unit 20 and be transferred via the diagnostic interface 23 to the external testing computer 17. Typical subsystems of an engine control system which are diagnosed are, for example:

the monitoring of catalytic converters,
the monitoring of the lambda probes,
the monitoring of the fuel metering system,
the monitoring of the secondary air system,
the monitoring of the exhaust gas recirculation,
the monitoring of the tank venting, and
the detection of misfiring.

The monitoring of the lambda probes takes place, for example, by there being fitted in addition to the lambda probe upstream of the catalytic converter also a second lambda probe downstream of the catalytic converter and by the fuel/air mixtures measured by the lambda probe being compared with one another at a certain operating point (for example during idling). If the measured fuel/air mixtures exhibit a certain deviation, there is a malfunction. Thus, for monitoring the lambda probes, the differential value of the measured fuel/air mixtures may be used as the diagnostic data item. For this differential value, a diagnostic threshold value must also be stored in the programmable memory 22 in order that the diagnostic program can detect faulty operation.

The monitoring of the secondary air system takes place, for example, by the secondary air pump being switched on during the warming up phase of the internal combustion engine. In this case, the lambda probe must be in an operative state. The secondary air injection can then be checked by the probe voltage being monitored in a certain time after the switching on of the secondary air pump. If the probe voltage has not reached a predetermined voltage value after the predetermined time, there is a defect in the secondary air pump. Thus, the voltage value of the lambda probe after the predetermined time following the point in time at which the pump is switched on can be used as the diagnostic data item. Thus, a diagnostic threshold value must also be provided in the programmable memory 22 for this variable.

The checking of the exhaust gas recirculation takes place, for example, by the intake pipe pressure after switching on the exhaust gas recirculation valve being monitored. If no change in the intake pipe pressure by a predetermined amount occurs within a predetermined time, faulty operation is the case. The intake pipe pressure after a predetermined time following switching on of the exhaust gas recirculation valve can thus likewise be used as a diagnostic data item. For this also, a diagnostic threshold value in the programmable memory 22 is required.

Finally, the detection of misfiring is mentioned as a further example. The detection of misfiring relies on the analysis of variations in the rotational speed of the internal combustion engine. This may also take place, for example, at a certain operating point of the internal combustion engine, such as idling operation.

On the basis of the variations in the rotational speed, a value for unsteady running is computed. If the value for unsteady running exceeds a specific limit value, there are multiple misfirings and a more accurate analysis must be performed in order to detect the cause of the misfirings. Thus, in this case the value for the unsteady running is used as the diagnostic data item. An upper diagnostic threshold value is also stored in the programmable memory 22 for this value.

Shown in FIG. 3 as an example is a data record which is transmitted from a vehicle to the central computer 10. Contained in the data record are all relevant items of information defining the motor vehicle type of the vehicle. These include the information on vehicle manufacturer, vehicle model, engine model and mileage. The vehicle type FT is established by these items of information. The information on the mileage is not absolutely necessary, but may likewise be used for distinguishing between various motor vehicle types in order to be able to observe the aging characteristics of vehicles more accurately. As further information, the vehicle identification number is also contained in the data record.

A vehicle with conspicuous characteristics can then be quickly identified and singled out for checking in the workshop. Contained in the data record as diagnostic data DD are the values for the lambda probe voltages, the computed unsteady running, the determined battery voltage, the lambda probe voltage after secondary air injection and the intake pipe pressure after opening the exhaust gas recirculation valve. This enumeration is, however, only by way of example. Further diagnostic data could likewise be contained in the data record. In particular, the adaptation values of the idling speed control and of the mixture adaptation of the internal combustion engine could also be contained in the data record.

Figure 4:
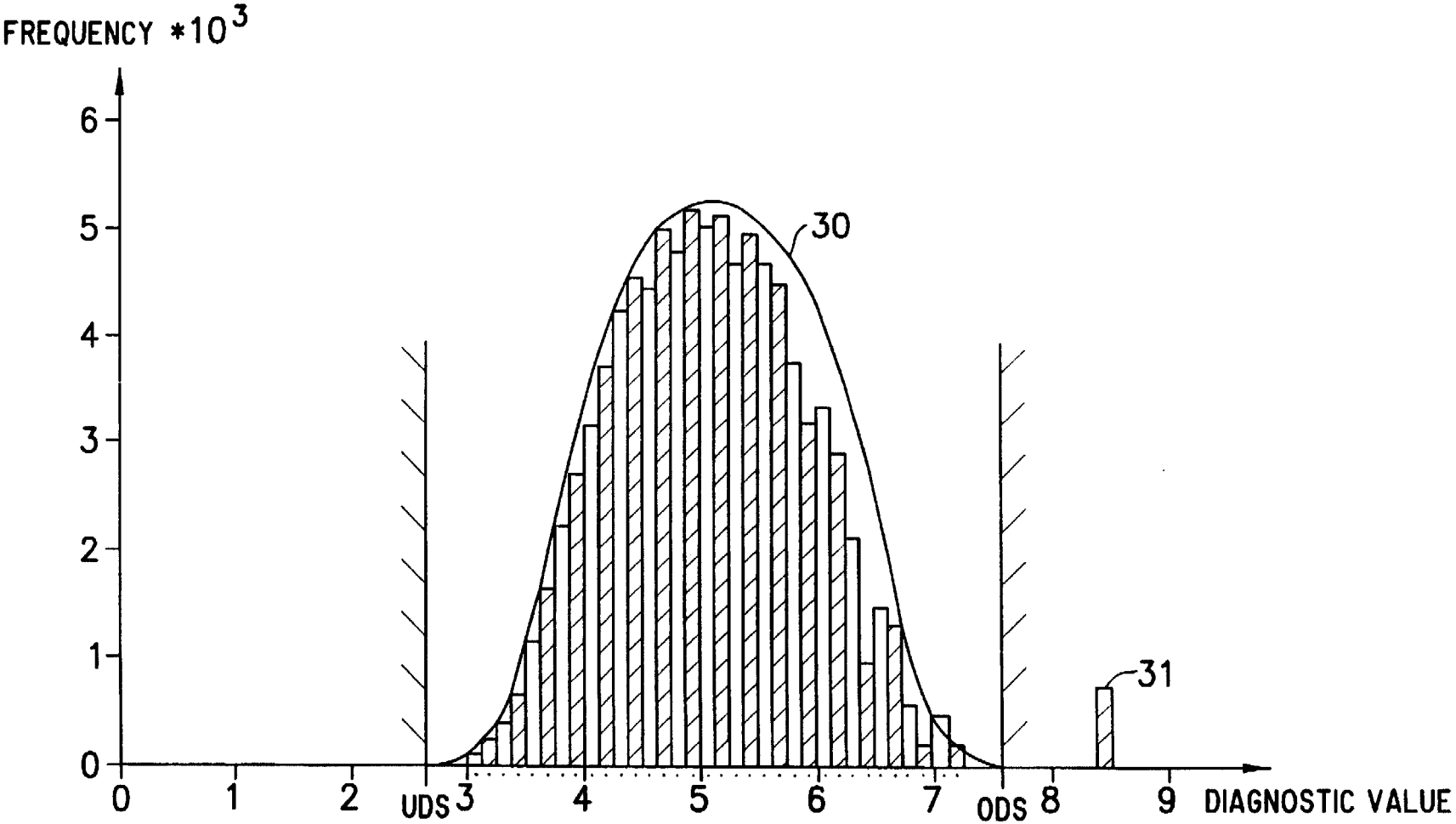
FIG. 4 shows an example of a frequency distribution of a diagnostic data item and the diagnostic threshold values established on the basis of the latter.

In FIG. 4 it is shown that the diagnostic data stored in the database of the motor vehicle type are statistically evaluated. In FIG. 4, a histogram is shown for a certain diagnostic data item of a data record for a motor vehicle type. Likewise shown is the distribution curve 30 which was determined from the histogram. Statistical characteristic quantities such as mean value and variance can then be formed from the histogram or the distribution function by the methods known from statistics. Depending on the safety requirement, the diagnostic threshold values (lower diagnostic threshold value UDS and upper diagnostic threshold value ODS) are then established. An example of a criterion which may be used for the establishment of the diagnostic threshold values is that a diagnostic threshold value must lie within a certain interval from the mean value of the distribution, the interval resulting from the determined variance of the distribution, in particular from a certain factor of the determined variance. The reference numeral 31 specifies a diagnostic value which lies outside the permissible range and is consequently classified as erroneous.

The diagnostic threshold values determined in the described way are subsequently stored during the next inspection of a vehicle of the motor vehicle type concerned in the programmable memory 22 of the electronic computing unit 20 of the respective vehicle. For this purpose, a corresponding program part is provided in the electronic computing unit. If new vehicles of the motor vehicle type are still being manufactured, the diagnostic threshold values established may also be written to the programmable memory right from the beginning at the end of the line in the production of the new vehicles. If need be, the programming of the diagnostic threshold values may also be performed via satellite or via radio masts installed on the ground.

Apart from altering data and diagnostic thresholds, functions, that is to say program parts, of the control programs can also be amended, provided that they are within storage media which permit this. It is consequently possible to benefit immediately in the field from experience gained by the creation of the database.

The programming of the programmable memories may, as already mentioned, take place via the interfaces described.

What is claimed is:

1. A method of determining a diagnostic threshold value for a preselected vehicle type, each of a plurality of motor vehicles of the preselected motor vehicle type having at least one electronic computing unit, each of the computing units having a programmable memory storing at least one diagnostic threshold value, a microcomputer for comparing at least one diagnostic data item to the at least one diagnostic threshold value and an interface for data communication with an external central computer, the method comprising the steps of:

transmitting the at least one diagnostic data item from each of a plurality of the computing units to the external central computer;

storing the diagnostic data items in a database of the external central computer;

forming a statistical distribution for the diagnostic items within the external central computer; and establishing a new value for the at least one diagnostic threshold value as a function of the statistical distribution.

2. The method according to claim 1, wherein each of the computing units includes an engine control device.

3. The method according to claim 1, further comprising the step of programming, after the new value for the at least one diagnostic threshold value has been established, the newly established value of the at least one diagnostic threshold value into the programmable memory of the computing unit of at least one of the plurality of motor vehicles of the preselected motor vehicle type.

4. The method according to claim 1, further comprising the steps of:

evaluating the diagnostic data items transmitted to the external central computer;

changing a program part of a control program for the computing units as a function of the evaluation; and programming the changed program part into the programmable memory of the computing unit of at least one of the plurality of motor vehicles of the preselected motor vehicle type.

5. The method according to claim 1, wherein the interface is a serial diagnostic interface connected to an external testing computer while the motor vehicle is in a workshop, and wherein the diagnostic data items are transmitted to the external testing computer before being transmitted to the external central computer.

6. The method according to claim 1, wherein the interface is for wireless communication with the external central computer.

7. The method according to claim 6, wherein the wireless communication is carried out via satellite.

8. The method according to claim 1, wherein the interface is for wireless communication with a computer connected upstream of the external central computer.

9. The method according to claim 1, further comprising the steps of:

transmitting the newly established value of the at least one diagnostic threshold value to at least one of the plurality of motor vehicles of the preselected motor vehicle type; and replacing the previous value of the at least one diagnostic threshold value with the newly established value of the at least one diagnostic threshold value.

10. An electronic computing unit for a motor vehicle, comprising:

an interface for data communication with an external computer;

a programmable memory coupled to the interface, wherein at least one diagnostic threshold value is stored in the programmable memory so that the diagnostic threshold value may be reset to a new diagnostic threshold value received from the external computer, wherein the new diagnostic threshold value is based on a statistical distribution by the external computer of diagnostic data items received from a plurality of vehicles of a preselected motor vehicle type; and a control unit coupled to the interface, at least one sensor for sensing at least one diagnostic data item and to the programmable memory, wherein the control unit detects a fault based on a comparison of the at least one diagnostic data item to the at least one diagnostic threshold value.

11. The computing unit according to claim 10, wherein programming the new diagnostic threshold value replaces an original diagnostic threshold value.

12. The computing unit according to claim 10, wherein the interface is a serial diagnostic interface, in accordance with ISO Standard 9141.

13. The computing unit according to claim 10, further comprising a non-volatile memory coupled to the control unit, the non-volatile memory storing a program, the program being executed by the control unit, in response to a command from the external computer, to program the new diagnostic threshold value into the programmable memory.

* * * * *

UNITED STATES PATENT AND TRADEMARK OFFICE

CERTIFICATE OF CORRECTION

PATENT NO. : 5,781,871

DATED : July 14, 1998

INVENTOR(S) : Manfred Mezger et al

It is certified that error appears in the above-identified patent and that said Letters Patent is hereby corrected as shown below:

Col. 1, line 13, delete "even" and insert --ever-- and after "more" insert --diagnostic--.

Col. 2, line 1, delete "respect to" (second occurrence).

Col. 7, line 17, after "interface," insert --to--.

Signed and Sealed this

Twenty-seventh Day of April, 1999

*Attest:*

*Attesting Officer*

Q. TODD DICKINSON

*Acting Commissioner of Patents and Trademarks*